US012622497B2

(12) United States Patent
Hbaich et al.

(10) Patent No.: US 12,622,497 B2
(45) Date of Patent: May 12, 2026

(54) HAIR CLAMP ADAPTER FOR APPLICATION OF COSMETIC COMPOSITIONS

(71) Applicant: L'Oreal, Paris (FR)

(72) Inventors: Ayoub Hbaich, Franklin Park, NJ (US); Rafael Feliciano, New Providence, NJ (US)

(73) Assignee: L'Oreal, Paris (FR)

( * ) Notice: Subject to any disclaimer, the term of this patent is extended or adjusted under 35 U.S.C. 154(b) by 57 days.

(21) Appl. No.: 18/930,422

(22) Filed: Oct. 29, 2024

(65) Prior Publication Data

US 2026/0114572 A1 Apr. 30, 2026

(51) Int. Cl.
*A45D 19/02* (2006.01)

(52) U.S. Cl.
CPC ..... *A45D 19/024* (2021.01); *A45D 19/026* (2021.01)

(58) Field of Classification Search
CPC .. A45D 19/022; A45D 19/024; A45D 19/026; B05C 17/00; B05C 17/00569; B05C 17/00596
See application file for complete search history.

(56) References Cited

U.S. PATENT DOCUMENTS

| | | | | |
|---|---|---|---|---|
| 1,749,748 | A * | 3/1930 | Tienken | A45D 1/18 132/127 |
| 4,727,893 | A | 3/1988 | Goncalves | |
| 11,427,396 | B2 | 8/2022 | Noel | |
| 2008/0083418 | A1* | 4/2008 | Glenn | A45D 19/016 132/270 |
| 2017/0196334 | A1* | 7/2017 | Elliott | A45D 19/012 |
| 2018/0325233 | A1* | 11/2018 | Roberts | A45D 19/028 |

FOREIGN PATENT DOCUMENTS

| | | |
|---|---|---|
| EP | 0224395 B1 | 6/1987 |

* cited by examiner

*Primary Examiner* — Eric J Rosen
*Assistant Examiner* — Sydney J Pulvidente
(74) *Attorney, Agent, or Firm* — Christensen O'Connor Johnson Kindness PLLC

(57) ABSTRACT

A hair clamp adapter, and formulation delivery devices and formulation delivery systems with the hair clamp adapter attached thereto. A hair clamp adapter is configured for attachment to and use with a formulation delivery device to controllably and evenly apply a cosmetic composition, such as a viscous or thickly lathered composition, to strands of hair of an individual. The hair clamp adapter includes a first compressible substrate and a second compressible substrate configured for passage of composition expelled from the formulation delivery device therethrough, such that contact of the first and second compressible substrates evenly distributes the composition between the compressible substrates for even and reliable application to the hair.

15 Claims, 6 Drawing Sheets

HAIR CLAMP ADAPTER FOR APPLICATION OF COSMETIC COMPOSITIONS

SUMMARY

In an aspect, the disclosure provides a hair clamp adapter configured for attachment to and use with a formulation delivery device to controllably apply a cosmetic composition to hair of an individual, the hair clamp adapter comprising: a moving handle slidingly attached to a moving arm that comprises a first compressible substrate thereon, and a stationary handle comprising a stationary arm that comprises a second compressible substrate thereon, wherein the moving arm is hingedly attached to the stationary arm via a hinge and is slidingly attached to the stationary handle; wherein the stationary arm and the second compressible substrate each comprises a plurality of apertures that are configured to align to form a plurality of formulation pathways for passage of the cosmetic composition therethrough; and wherein a bias of the hair clamp adapter biases the hair clamp adapter toward an unclamped configuration, and wherein the bias is overcome the hair clamp adapter transitions toward a clamped configuration.

In embodiments, the moving handle is slidingly attached to the moving arm via a sliding male member slidingly engaged within an elongated aperture.

In embodiments, the moving arm is slidingly attached to the stationary handle via a sliding male member slidingly engaged within an elongated aperture.

In embodiments, the bias is produced by a spring attached to the moving handle at a first end thereof and attached to the stationary handle at a second end thereof, wherein the spring is biased toward an expanded configuration to distance the moving handle from the stationary handle and distance the moving arm from the stationary arm to form the open configuration.

In embodiments, the hair clamp adapter further comprises a living hinge that hingedly connects a proximal portion of the moving handle to a proximal portion of the stationary handle and is configured to prevent contact between a portion of a hand of the individual and a junction that includes the moving arm and the stationary arm for avoidance of injury.

In embodiments, the stationary handle and arm comprises a proximal connector and a distal connector that are configured to connect the hair clamp adaptor to the formulation delivery device.

In embodiments, the proximal connector, the distal connector, or both, comprises a magnet configured for a magnetic attachment of the hair clamp adapter to the formulation delivery device via contact with one or more corresponding magnets of the formulation delivery device.

In embodiments, the stationary arm comprises a plurality of standoff portion slots configured as apertures for receipt and securement of a plurality of standoff portions of the formulation delivery device therein, for maintenance of an orientation of the hair clamp adapter relative to an orientation of the formulation delivery device during attachment and use.

In embodiments, apertures of the plurality of apertures of the second compressible substrate are positioned between opposing standoff portion slots of the plurality of standoff portion slots.

In embodiments, the plurality of formulation pathways are positioned for a fluid connection with the reciprocating nozzle assembly for passage of the cosmetic composition from the reciprocating nozzle assembly through the plurality of formulation pathways via the fluid connection.

In embodiments, passage of the cosmetic composition through the plurality of formulation pathways contacts the cosmetic composition to the second compressible substrate for absorption of the cosmetic composition therein for delivery to the hair of the individual through the second compressible substrate.

In embodiments, passage of the cosmetic composition through the plurality of formulation pathways passes the cosmetic composition through the plurality of apertures of the second compressible substrate such that the cosmetic composition forms a plurality of formulation dribbles on the second compressible substrate.

In embodiments, the first and second compressible substrates are removable from the moving arm and the stationary arm, respectively.

In embodiments, passage of the cosmetic composition through the plurality of formulation pathways forms a plurality of formulation dribbles on the second compressible substrate, and the bias is overcome to transition the hair clamp adapter toward the clamped configuration such that the first compressible substrate is contacted with the plurality of formulation dribbles for transfer of the cosmetic composition to the first compressible substrate to evenly apply the cosmetic composition to the hair of the individual.

In other aspects, the disclosure provides a formulation delivery device or formulation delivery system comprising a hair clamp adapter.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

TABLE 1

Figure 1:
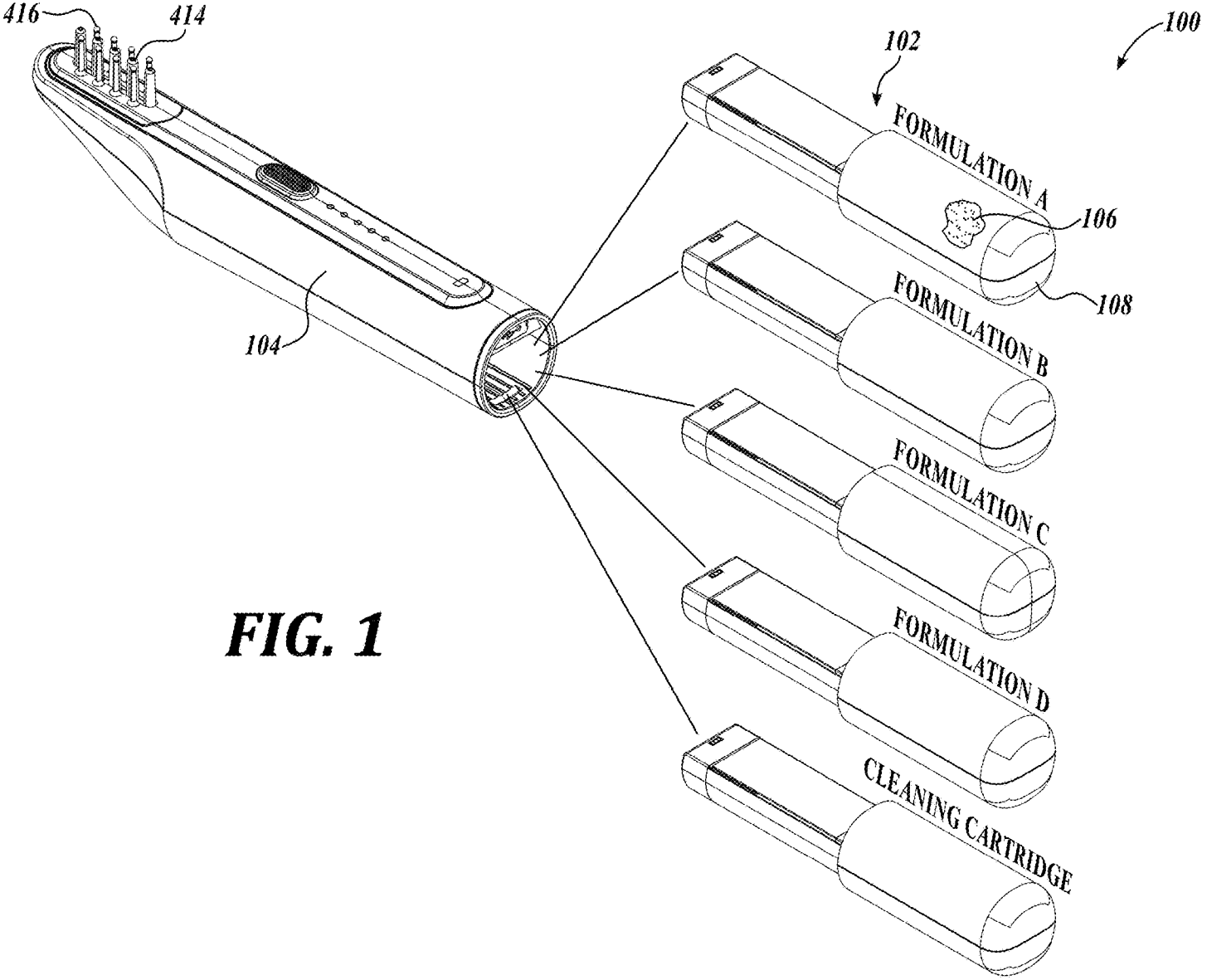
FIG. 1 shows a schematic view of an example formulation delivery system, according to aspects of the disclosure.

Drawings elements and descriptions.

| Reference | Description |
|---|---|
| 100 | Formulation delivery system |
| 102 | Formulation product line |
| 104 | Formulation delivery device |
| 106 | Formulation |
| 108 | Formulation cartridge |

TABLE 1-continued

| Drawings elements and descriptions. | |
|---|---|
| Reference | Description |
| 200 | Formulation cartridge |
| 202 | Handle portion |
| 203 | First half |
| 204 | Second half |
| 206 | Reservoir |
| 208 | Output nozzles |
| 210 | Front body portion |
| 212 | Refill unit |
| 300 | Hair clamp adapter |
| 301 | Moving handle |
| 301a | Elongated aperture |
| 302 | Stationary handle and stationary arm |
| 302a | Sliding male member |
| 302b | Formulation delivery device connector (proximal) |
| 302c | Formulation delivery device connector (distal) |
| 303 | Spring |
| 304 | Living hinge |
| 305 | Moving arm |
| 305a | Hinge |
| 305b | Sliding male member |
| 305c | Elongated aperture |
| 306a | Compressible substrate (moving arm) |
| 306b | Compressible substrate (stationary arm) |
| 307a | Formulation pathway through compressible substrate |
| 307b | Formulation pathway through compressible substrate |
| 307c | Formulation pathway through compressible substrate |
| 307d | Formulation pathway through compressible substrate |
| 308 | Formulation dribble |
| 309a | Standoff portion slot |
| 309b | Standoff portion slot |
| 309c | Standoff portion slot |
| 309d | Standoff portion slot |
| 309e | Standoff portion slot |
| 309f | Standoff portion slot |
| 309g | Standoff portion slot |
| 309h | Standoff portion slot |
| 400 | Formulation delivery device (with hair clamp adapter attached) |
| 402 | Formulation cartridge |
| 408 | Cartridge interface |
| 410 | Formulation dispensing assembly |
| 412 | Controller |
| 414 | Reciprocating nozzle assembly |
| 416 | Plurality of standoff portions |
| 418 | Formulation vessel(s) |
| 420 | Output nozzle |
| 422 | Formulation inlet |
| 426 | Button |
| 428 | Visual indicators (e.g., light-emitting diodes; LEDs) |
| 430 | Cartridge authentication interface |

The foregoing aspects and many of the attendant advantages of this disclosure will become more readily appreciated as the same become better understood by reference to the following detailed description, when taken in conjunction with the accompanying drawings.

DETAILED DESCRIPTION

At least some hair formulations can be relatively thick or viscous, and difficult to apply to the hair in correct amounts. This leads to underapplication of the haircare formulation due to difficulty applying the composition and overapplication due to difficulty removing excess composition. Using approaches as disclosed herein, haircare fluid formulation systems and devices, such as the Colorsonic™ device as commercially provided by L'Oreal as a non-limiting example, can be advantageously configured for accurate and precise application of haircare formulas, including viscous formulations, for hair cleaning and treatments, without underapplication or overapplication of the compositions. The disclosed approaches are able to controllably contact and compress the hair, and deliver steady amounts of fluid formulations to the hair through the use of a hair clamp adapter that includes one or more compressible materials, such as one or more sponges, that transmit the formula therethrough to clamped strands of the hair and enable the user to apply the composition to the hair and wipe away excess composition with edge portions of the one or more sponges, as part of a scraping movement. The disclosed approaches also enhance formulation delivery systems for even distribution of the composition across multiple strands of hair, enabling consistent results.

Figure 2:
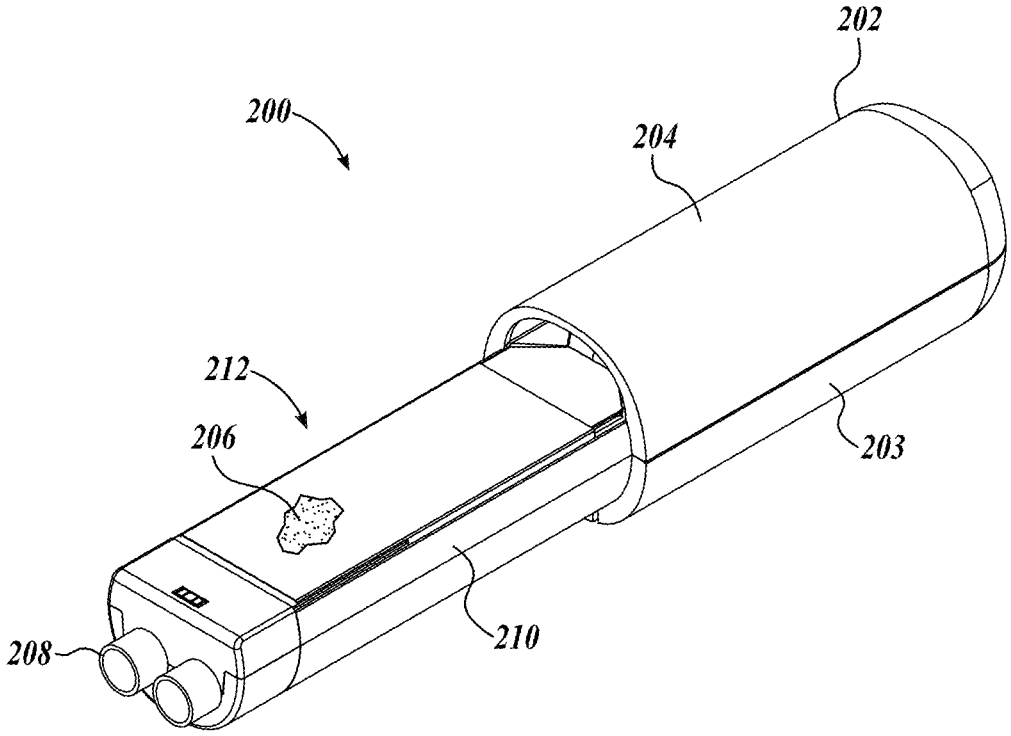
FIG. 2 shows a rear perspective view of an example formulation cartridge, according to aspects of the disclosure.

A formulation delivery system can be configured for compatible use with any of a plurality of formulation cartridges. By way of a non-limiting example, FIG. 1 shows a side perspective view of an example formulation delivery system, and FIG. 2 shows a rear perspective view of an example formulation cartridge. A formulation delivery system 100 can include a formulation cartridge 200. The shown formulation delivery system 100 is an example of a formulation delivery system as described in detail in U.S. Patent Application Publication No. US20240172858A1, published May 30, 2024, and assigned to L'Oreal, which is incorporated by reference herein in its entirety for all purposes. However, it is to be understood that aspects and embodiments of the present disclosure can be used with any formulation delivery system for hair coloring and/or hair bleaching, without departing from the scope and spirit of the disclosure.

The shown example formulation delivery system 100 includes a formulation product line 102, a formulation delivery device 104, and a formulation 106 (e.g., within a liquid reservoir 206 of a formulation cartridge 108, shown as a cutaway view within FIGS. 1-2), which together enable application of a cosmetic composition to the hair of an individual for a personalized hair treatment experience, such as hair coloring and/or bleaching. Formulation product line 102 includes formulation cartridges 108, and formulation cartridges 108 can be of a same (or common) cartridge type configured for interchange and use with the formulation delivery device 104.

The formulation product line 102 can include a cosmetic composition as a hair bleaching formulation, which can include a bleach formula and a developer formula which, when mixed together by the formulation delivery device 104, form the cosmetic composition to be applied to the hair of an individual. In embodiments, a formulation product line 102 can comprise one or more cartridges that comprise: a bleach formula and a developer, a permanent hair dye and a developer, a semi-permanent hair dye and a developer, a shampoo, a conditioner, a hair growth treatment such as minoxidil, a hair protein treatment, a disulfide bond repairing hair treatment, a fluid scalp treatment, or the like.

In embodiments, a formulation product line 102 can include a cleaning cartridge comprising a cleaning solution therein for cleaning the formulation delivery device 104 before and/or after use. A cleaning solution can enable an individual to clean the formulation delivery device 104 by executing a cleaning routine, with the device and the cleaning solution cartridge, that flushes a cleaning liquid (e.g., water, saline) from the cleaning cartridge through fluid conduits of the formulation delivery device 104. This removes residual formulation from the formulation delivery device 104. Advantageously, the cleaning cartridge and cleaning routine enable a significant portion of the formulation delivery device 104 to be reused for different formulations, thereby reducing waste and cost. The cleaning cartridge can include a refillable cleaning liquid reservoir disposed inside the outer housing, which is fluidically connected to the plurality of output nozzles. Thus, a user can fill the cleaning liquid reservoir with a cleaning liquid such as water, execute a number of cleaning routines on the formulation delivery device 104, and refill the cleaning liquid reservoir.

The shown formulation cartridge 108 has an elongate shape and dimensions configured for insertion into a handle of the formulation delivery device 104, in particular into a cartridge cavity of the handle, for mixing and dispensing the cosmetic composition from the formulation delivery device 104. All or substantial portions of a formulation cartridge 108 can be comprised of one or more recyclable elements, for example, for managing the environmental impact of the system and product line.

The formulation cartridge 108 can comprise a plurality of liquid output nozzles, which are sized and positioned at a distal (forward) end of the formulation cartridge 108 in a configuration that fluidically connects with a corresponding plurality of liquid inlets (e.g., first formulation inlets) of the formulation delivery device 104. In embodiments, the liquid output nozzles are valves of formulation vessels (e.g., pouches or packets) disposed in formulation cartridge 108.

FIG. 2 shows a formulation cartridge 200 which is compatible with any of the formulation delivery systems, formulation delivery devices, and formulation product lines described herein. However, the formulation delivery systems, formulation delivery devices, and formulation product lines described herein are not necessarily required to use the sustainable formulation cartridge 200 shown in FIG. 2.

In embodiments, the formulation cartridge 200 is sustainable and is designed to reduce waste and environmental impact, while delivering a user-friendly experience. It includes two main components: a handle portion 202 and a disposable formulation cartridge refill unit 212 (hereinafter referred to simply as refill unit 212) configured to reversibly slide into the handle portion 202. The formulation cartridge 200 is constructed such that the handle portion 202 can be reused indefinitely and the refill units 212 can be readily replaced after depletion of the formulation stored therein. Furthermore, refill unit 212 can be configured to be deconstructed into smaller components, at least some of which can be recycled in embodiments, and others disposed of. Thus, the formulation cartridge 200 utilizes an innovative structure to reduce waste and improve the user experience.

In embodiments, handle portion 202 is sized, dimensioned, and constructed to be repeatedly inserted into the cartridge cavity of the formulation delivery device. Accordingly, handle portion 202 can be formed of a plastic or similar rigid polymer or other material and includes a hollow handle portion 202 configured to receive the refill unit 212 therein. Refill unit 212 includes a refill packet comprising a shell enclosing at least one formulation vessel (e.g., a packet, pouch, or other vessel), for example a first formulation pouch and a second formulation pouch, and a valve frame coupled with the refill packet, e.g., a front body portion 210. In embodiments, at least one formulation vessel is a liquid reservoir 206. The first formulation pouch and second formulation pouch can contain a first formulation (e.g., bleach formula) and a second formulation (e.g., developer formula), respectively. The refill unit 212 can include a packet sleeve. In embodiments, a formulation vessel can comprise a formulation packet and an output nozzle.

In embodiments, the first formulation pouch and second formulation pouch, of the formulation cartridge 200, can each have a volume of about 40 mL to about 70 mL, about 50 mL to about 60 mL, about 40 mL to about 65 mL, about 40 mL to about 60 mL, about 40 mL to about 55 mL, about 40 mL to about 50 mL, about 45 mL to about 70 mL, about 50 mL to about 70 mL, about 55 mL to about 70 mL, about 60 mL to about 70 mL, or about 55 mL. In embodiments, first and second formulation pouches can have different volumes. In embodiments, refill unit 212 stores only one formulation vessel.

In embodiments, the first formulation and second formulation can be independently selected from any of the formulations described herein, or their equivalents in the art, and can include at least one non-fluid formulation, for example, a bleach formula, a permanent hair dye, a semi-permanent hair dye, a developer formula, a conditioner, a hair growth treatment such as minoxidil, a hair protein treatment, a disulfide bond repairing hair treatment, a fluid hair treatment, a fluid scalp treatment, and any combination thereof, or the like. In embodiments, the first formulation and second formulation differ. For example, in some embodiments, the first formulation is a bleach formula and the second formulation is a developer. In other embodiments, the first formulation and second formulation are the same (e.g., a conditioner or scalp treatment formulation).

In embodiments, formulation pouches include a formulation-containing packet and valve means comprising output nozzles 208 for selectively-fluidic coupling the refill unit to a dispensing nozzle unit of a formulation delivery device when the formulation cartridge 200 is received within the hand-held formulation dispensing device. Representative valve means include a valve through which the formulation exits the formulation-containing packet. Example formulation vessels are described in International Patent Application Publication No. WO2019067336A2, published Apr. 4, 2019, and assigned to L'Oreal S A, and U.S. Patent Application Publication No. US20210196021A1, published Jul. 1, 2021, and assigned to L'Oreal S A, both of which are hereby incorporated by reference in their entireties for all purposes.

In embodiments, the shell (i.e., outer portion) of the cartridge refill unit 212 has an elongate shape sized to be received within the reusable handle portion 202. The shell encloses and protects the first formulation pouch and second formulation pouch and engages the valve frame (described below). Thus, the shell functions as packaging which protects the formulation pouches during commerce prior to loading into the formulation delivery device.

In embodiments, the shell has a total length between 150 and 250 mm (e.g., 175-225 mm, 185-215 mm, 195-205 mm, or 200 mm) and a maximum cross-sectional dimension of 25-50 mm (e.g., 30-45 mm, 35-40 mm, or 36 mm). The shell has a rear body portion and a slender front body portion 210, e.g., a neck portion, extending away from the body portion. The body portion and the slender front body portion 210 generally align in a common longitudinal direction to enable assembly with the reusable handle portion 202, and to enable insertion into the cartridge cavity of the formulation delivery device. In embodiments, the shell is constructed at least partially from a recyclable or recycled material, e.g., a paper material such as an injection-molded paper material or a die-cut structured paper (e.g., cardboard). In embodiments, the shell is formed from a single piece of injection-molded paper material. In embodiments in which the shell is formed of paper, the paper has a weight between 8-12 points (e.g., 8.5 points, 9.0 points, 9.5 points, 10.0 points, 10.5 points, 11.0 points, or 11.5 points), to impart sufficient stiffness without contributing excess disposable material.

In embodiments, the rear body portion of the shell has a larger cross-sectional dimension than the front body portion 210 when viewed in a plane normal to the longitudinal direction of the formulation cartridge 200. A hump or bulge imparts the larger cross-sectional area of the rear body portion relative to the slender front body portion 210. Advantageously, the hump or bulge enables the use of higher-volume formulation pouches. Additionally, the hump or bulge forms an abutment which abuts a corresponding interior face of the handle portion 202 and secures the longitudinal position of the shell during use, for example, by friction fit.

In embodiments, the slender front body portion 210 of the shell is sized to fit within the handle portion 202 and to project into the cartridge cavity of the formulation delivery device during use. The front body portion 210 couples with the valve frame. To facilitate secure connection and alignment with the valve frame, the front body portion 210 includes valve frame coupling means, for example at least one coupling tab configured to selectively engage the valve frame. In the illustrated embodiment, the front body portion 210 includes a single coupling tab extending away from a front end thereof. The coupling tab includes an engagement feature, for example a detent or raised prominence shaped and sized to engage a complementary aperture of the valve frame.

In embodiments, the shell can have any of various different configurations. For example, the shell can be a clamshell configuration formed with at least two partial shells (in this embodiment, first half 203 and second half 204) hingedly coupled. In embodiments, the shell includes a different number of partial shells, e.g., three or four partial shells which come together to enclose the formulation pouches. In still other embodiments, the shell comprises a single piece forming an open-ended tube into which the formulation pouches can be inserted. Alignment of the first half 203 and second half 204 enables correct attachment of the front body portion 210 to the valve frame.

While the illustrated shell is formed of an injection molded paper material, this construction is an example and is not limiting. In embodiments, the shell is formed of a single piece of die-cut paper stock, which is folded to impart a three-dimensional structure having the rear body portion and slender front body portion 210 extending away therefrom. In embodiments, this folded construction creates a polygonal cross section in the rear body portion and a polygonal cross section in the front body portion 210 (for example, octagonal and hexagonal cross sections, respectively). To facilitate assembly, embodiments of the shell include one or more scores or guidelines that ensure correct folding. Embodiments have a triangular, rectangular, pentagonal, hexagonal, heptagonal, octagonal, or other polygonal cross-sectional shape.

In embodiments, a packet sleeve can slide over the front body portion 210 and provide several important advantages. First, it imparts additional structure to the refill unit 212 by sliding over and reinforcing front body portion 210. Accordingly, in embodiments, packet sleeve has a greater weight or thickness as compared to the material that forms the shell; although this is not required. In embodiments, packet sleeve is formed of a recyclable material, which can be the same material as the shell. In embodiments, packet sleeve couples with the valve frame. For example, the packet sleeve can include a plurality of engagement member recesses configured to reversibly couple with engagement members of the valve frame. The packet sleeve can facilitate disassembly of the refill unit 212.

In embodiments, the valve frame provides a rigid structure which aligns the output nozzles 208 for correct fluid interconnection with the fluid conduits of the formulation delivery device. Accordingly, the valve frame can be formed from ABS plastic, HDPE, or another rigid polymer or other material. In embodiments, the valve frame is formed from a same material as the shell. Thus, the shell, formulation pouches, valve frame, and optional packet sleeve form the refill unit 212. In use, refill unit 212 is reversibly couplable with handle portion 202, e.g., by securing means such as coupling tabs on the shell or by friction fit between the refill unit 212 and the handle portion 202.

Figure 3A:
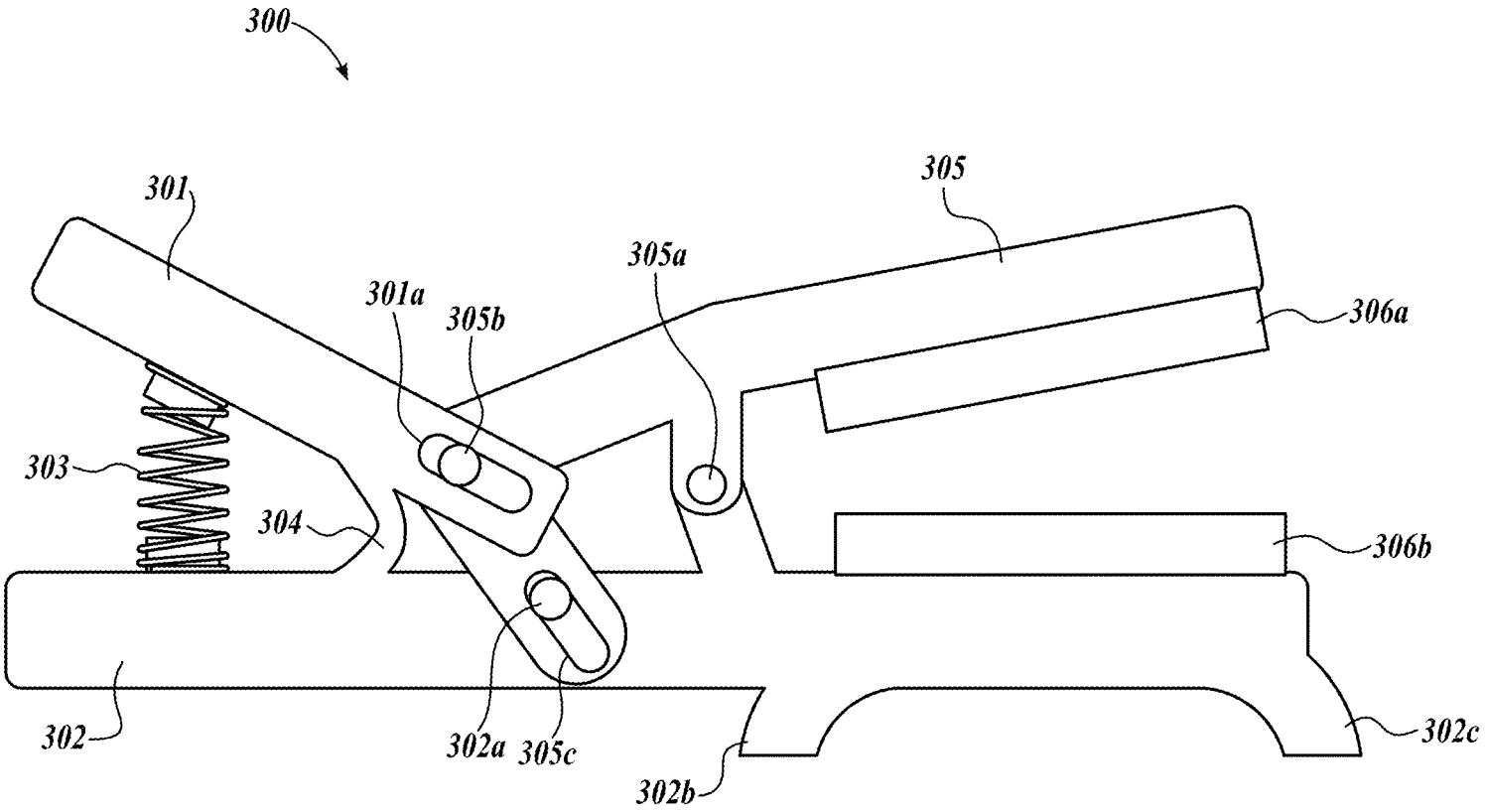
FIG. 3A shows a side view of an example hair clamp adapter, according to aspects of the disclosure.
Figure 3B:
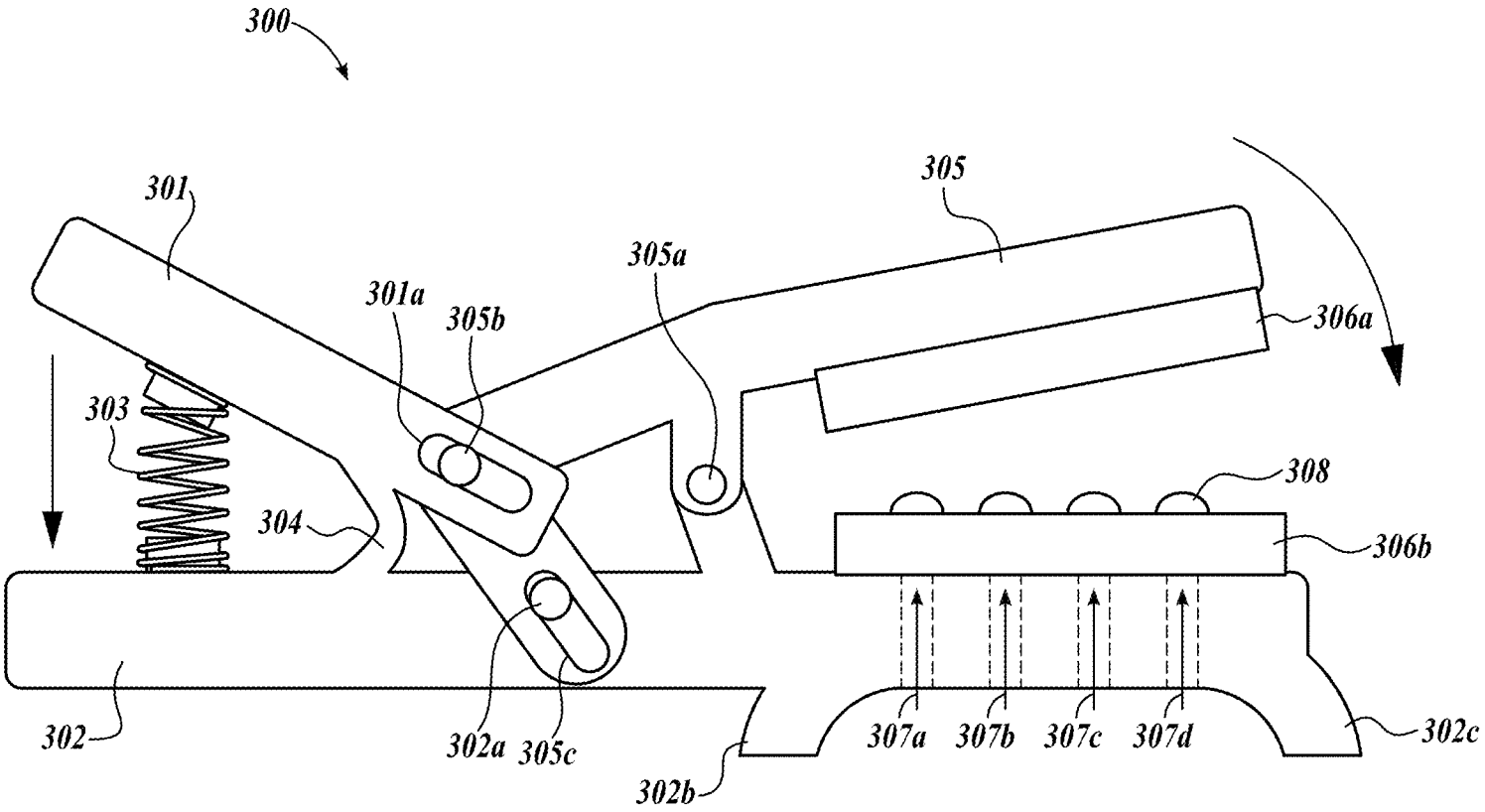
FIG. 3B shows a side view of an example hair clamp adapter with a cosmetic composition passing through a compressible substrate or sponge of the adapter, according to aspects of the disclosure.
Figure 4:
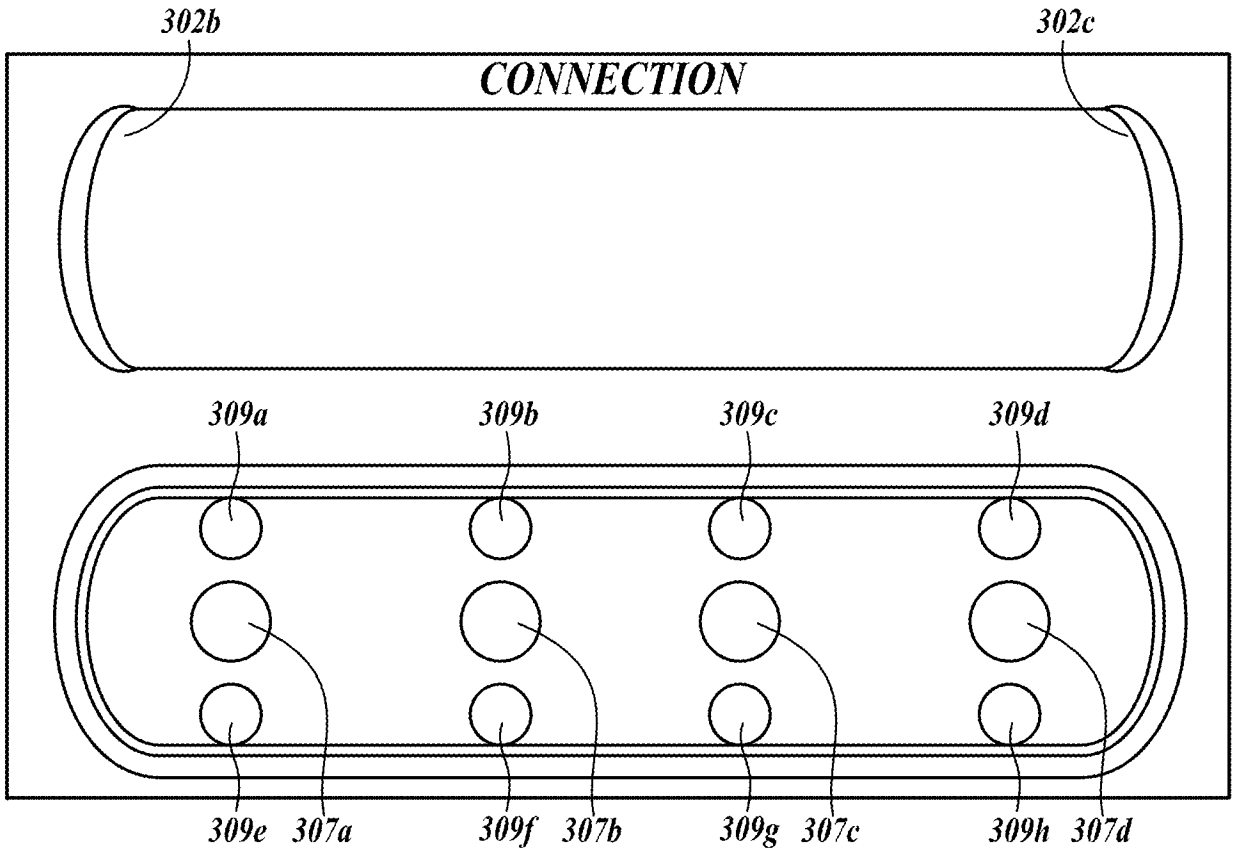
FIG. 4 shows a bottom view (top) and a top view (bottom) of an example stationary handle and stationary arm of the example hair clamp adapter, according to aspects of the disclosure.

As shown by way of an example at FIG. 3A, a hair clamp adapter 300 is configured for attachment to and use with a formulation delivery device (e.g., 104 of FIG. 1) to controllably apply a cosmetic composition to hair of an individual. The hair clamp adapter 300 comprises a moving handle 301 slidingly attached to a moving arm 305 that comprises a first compressible substrate 306*a* thereon, and a stationary handle comprising a stationary arm 302 that comprises a second compressible substrate 306*b* thereon. The moving arm 305 is hingedly attached to the stationary arm 302 via a hinge 305*a* and is slidingly attached to the stationary handle 302. As shown at FIG. 3B and FIG. 4, the stationary arm 302 and the second compressible substrate 306*b* each comprises a plurality of apertures (i.e., dotted lines of FIG. 3B, through which formulation pathways 307*a*, 307*b*, 307*c*, 307*d* are formed; see also formulation pathways 307*a*, 307*b*, 307*c*, and 307*d* of FIG. 4). The plurality of apertures of the stationary arm 302 are configured to align with a plurality of apertures of the second compressible substrate 306*b* to form a plurality of formulation pathways 307*a*, 307*b*, 307*c*, and 307*d*, for passage of the cosmetic composition therethrough. In the shown embodiment of FIGS. 3A-3B, a bias of the hair clamp adapter 300, for example as formed by a spring 303, biases the hair clamp adapter 300 toward an unclamped configuration (i.e., as shown at FIG. 3B); as the bias is overcome as a result of a squeezing force applied to the moving handle 301 and/or the stationary handle 302, as occurs as a user grips the moving handle 301 and the stationary handle 302, the hair clamp adapter 300 transitions toward a clamped configuration (i.e., such that the compressible substrates 306*a*, 306*b* contact each other and the moving handle 301 contacts the stationary handle 302). In the clamped configuration, which can visually correspond to a pair of scissors in a closed configuration, a formulation dribble 308 contacts the compressible substrate 306*a* (i.e., on the moving arm 305), to transfer the cosmetic composition from the compressible substrate 306*b* of the stationary arm 302 to the compressible substrate 306*a* of the moving arm 305. In this manner, the cosmetic composition is consistently and evenly distributed along the compressible substrates 306*a*, 306*b*, forming a lather to be evenly applied to the hair during a hair treatment.

In embodiments, compressible substrates 306*a*, 306*b* can be comprised of naturally-occurring materials, such as sea sponges, or can be comprised of artificial or man-made materials, such as synthetic sponges or the like. The compressible substrates 306*a*, 306*b* can be water-permeable, such that aqueous cosmetic compositions can penetrate the body the of compressible substrate and be expelled, e.g., through holes of the compressible substrates, to evenly contact the hair during use.

In embodiments, the moving handle 301 is slidingly attached to the moving arm 305 via a sliding male member 305*b* that is slidingly engaged within an elongated aperture 301*a*. During movement of the moving handle 301 relative to the stationary handle 302, the sliding male member 305*b* slides within the elongated aperture 301*a* for controlled relative movement of the moving handle 301 and the moving arm 305. In addition, in embodiments, the moving arm 305 is slidingly attached to the stationary handle 302 via a sliding male member 302*a* slidingly engaged within an elongated aperture 305*c* (of the moving arm 305). The shown example configuration of these elements, and equivalents thereof, enables an angle between the compressible substrates 306*a*, 306*b* to be minimized in both the open (unclamped) and closed (clamped) configurations, such that the compressible substrates 306*a*, 306*b* contact each other more evenly.

The shown example configuration, and equivalents thereof for minimizing the angle between the compressible substrates 306*a*, 306*b*, can be contrasted with a typical "scissor" configuration, in which a single hinge would connect two moving members for a rigid scissor movement. For example, if a typical "scissor" configuration were used for closing the compressible substrates 306*a*, 306*b* together, this could cause uneven contact therebetween, leading to stronger contacts at portions of the compressible substrates next to the hinge and expulsion of cosmetic composition therefrom, and weaker contacts at portions of the compressible substrates distal from the hinge and accumulation of excess cosmetic composition thereon. This uneven distribution of the cosmetic composition could lead to the composition being unevenly applied to the hair during a hair treatment which could frustrate use of the clamp adapter.

In the shown embodiment, the bias is produced by a spring 303 attached to the moving handle 301 at a first end thereof and attached to the stationary handle 302 at a second end thereof. The spring is biased toward an expanded configuration (e.g., as shown at FIGS. 3A-3B), to distance the moving handle 301 from the stationary handle 302 and distance the moving arm 305 from the stationary arm 302 to form the open configuration.

In embodiments, the hair clamp adapter 300 further comprises a living hinge 304 that hingedly connects a proximal portion of the moving handle 301 to a proximal portion of the stationary handle 302, and is configured to prevent contact between a portion of a hand of the individual and a junction that includes the moving arm 301 and the stationary arm 302; in this manner, the living hinge 304 can prevent or reduce the risk of injury during use of a formulation delivery device comprising the hair clamp adapter 300 attached thereto.

In embodiments, the stationary handle and arm 302 comprises a proximal connector 302*b* and a distal connector 302*c* that are configured to connect the hair clamp adaptor 300 to the formulation delivery device 400, including as shown by way of an example at FIGS. 3A-3B, 4, and 5. In embodiments, the proximal connector 302*b*, the distal connector 302*c*, or both, comprises a magnet configured for a magnetic attachment of the hair clamp adapter 300 to the formulation delivery device 400 via contact with one or more corresponding magnets of the formulation delivery device 400.

In embodiments, the stationary arm 302 comprises a plurality of standoff portion slots 309*a*, 309*b*, 309*c*, 309*d*, 309*e*, 309*f*, 309*g*, 309*h*, configured as apertures, for receipt and securement of a plurality of standoff portions 416 of the formulation delivery device 104 therein (see FIGS. 1, 4, and 5), for maintenance of an orientation of the hair clamp adapter 300 relative to an orientation of the formulation delivery device 104 during attachment and use.

In embodiments, including as shown by way of a non-limiting example at FIG. 4, apertures of the plurality of apertures of the second compressible substrate 306*b* are positioned between opposing standoff portion slots of the plurality of standoff portion slots 309*a*, 309*b*, 309*c*, 309*d*, 309*e*, 309*f*, 309*g*, 309*h*, and form a plurality of formulation pathways 307*a*, 307*b*, 307*c*, 307*d*, when aligned with a reciprocating nozzle assembly 414 of a formulation delivery device (e.g., 104 of FIG. 1). As such, in embodiments, the plurality of formulation pathways 307*a*, 307*b*, 307*c*, 307*d* are positioned for a fluid connection with the reciprocating nozzle assembly 414 for passage of the cosmetic composition from the reciprocating nozzle assembly 414 through the plurality of formulation pathways 307*a*, 307*b*, 307*c*, 307*d* via the fluid connection. As a result, in embodiments including as shown at FIG. 3B as a non-limiting example, passage of the cosmetic composition (from the reciprocating nozzle assembly 414) through the plurality of formulation pathways 307*a*, 307*b*, 307*c*, 307*d* contacts the cosmetic composition to the second compressible substrate 306*b* for absorption of the cosmetic composition therein for delivery to the hair of the individual through the second compressible substrate 306*b*. This process, passage of the cosmetic composition through the plurality of formulation pathways 307*a*, 307*b*, 307*c*, 307*d*, also passes the cosmetic composition through the plurality of apertures of the second compressible substrate 306*b* such that the cosmetic composition forms a plurality of formulation dribbles 308 on the second compressible substrate 306*b*.

In embodiments, the first and second compressible substrates 306*a*, 306*b* are removable from the moving arm 305 and the stationary arm 302, respectively. In this manner, the first and second compressible substrates 306*a*, 306*b* can be cleaned as part of maintenance, or discarded and replaced with new compressible substrates.

In various embodiments, with passage of the cosmetic composition through the plurality of formulation pathways 307*a*, 307*b*, 307*c*, 307*d* and formation of a plurality of formulation dribbles 308 on the second compressible substrate 306*b*, the bias can be overcome to transition the hair clamp adapter toward the clamped configuration such that the first compressible substrate 306*a* is evenly contacted with the plurality of formulation dribbles 308 for transfer of the cosmetic composition to the first compressible substrate 306*a* to evenly apply the cosmetic composition to the hair of the individual.

In various embodiments, a formulation mixer of the formulation delivery device can be implemented as a turbulent mixing chamber that comprises one or more helical mixers positioned within a fluidic pathway, and carries, mixes, and homogenizes a mixture of formulations to produce the resultant formulation or cosmetic composition to be applied to the hair. However, other types of formulation mixers can be implemented without departing from the scope and spirit of the disclosure. In the shown embodiments, a reciprocating nozzle assembly 414 comprises a plurality of nozzles (e.g., spaced apart and separated by a plurality of standoff portions 416), and is driven by a motor, such that the plurality of nozzles reciprocate back-and-forth along a track while dispensing the resultant formulation; however, alternate nozzle assembly designs can be implemented without departing from the scope and spirit of the disclosure.

In addition, in embodiments, control of a mix ratio between two or more formulations can advantageously contribute to various properties of the resultant cosmetic composition, such as potency and, as a result, the time needed to apply the composition to the hair to achieve a desired effect.

Furthermore, in embodiments, control circuitry of the formulation delivery device 104 can be configured based on a software application, executed by at least one process of the formulation delivery device 104 or another computational device, such as a smartphone, that defines relative amounts of two or more formulas to be mixed for a particular hair treatment. Accordingly, in embodiments, the control circuitry is configured to receive one or more signals from one or more formulation cartridges that corresponds to one or more formulations of the plurality of formulations, and compute the mix ratio based on the one or more signals. The signals can be received by the circuitry by way of any connection with the formulation cartridges, including but not limited to a wired connection, or a wireless connection, such as a wireless query of a radiofrequency identification (RFID) chip of a formulation cartridge, for example.

Figure 5:
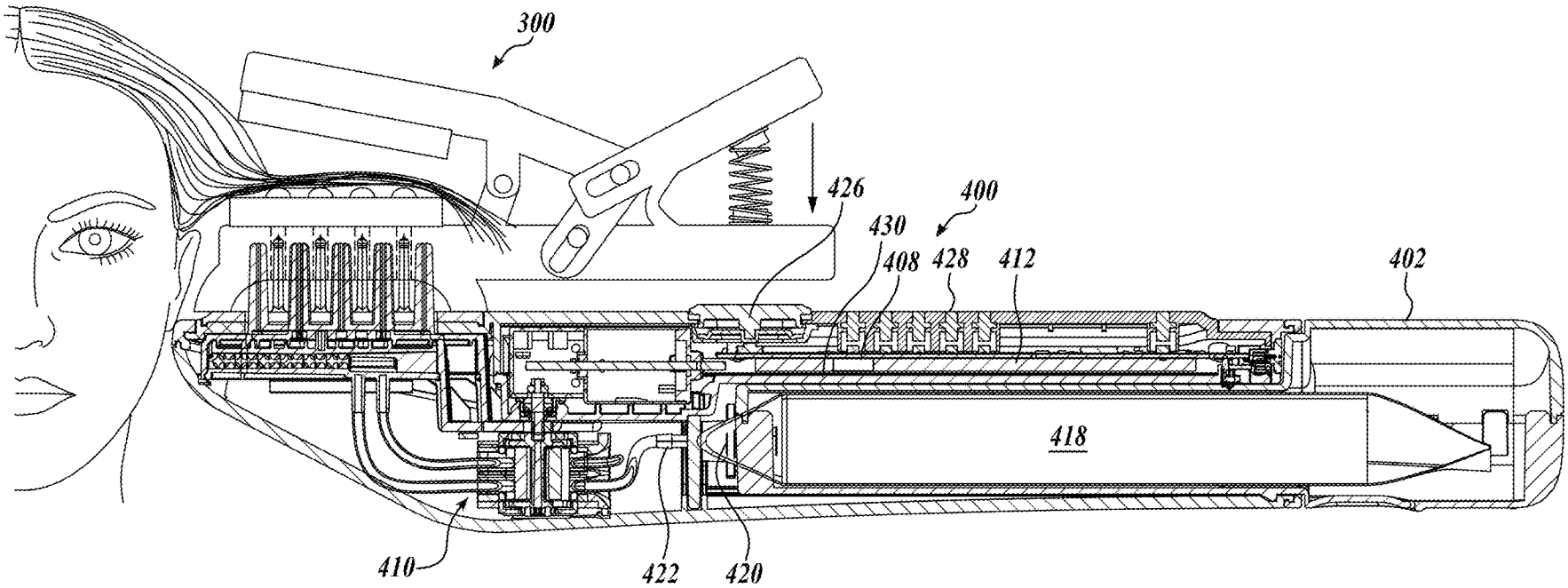
FIG. 5 shows a side view (hair clamp adapter) with cutaway (formulation delivery device) showing a hair treatment to apply a haircare formulation to the hair of an individual, according to aspects of the disclosure.

In various aspects, the disclosure provides a formulation delivery device or formulation delivery system comprising a hair clamp adapter attached thereto or configured to be attached thereto. While an example of a formulation delivery device with hair clamp adapter attached thereto 400 is shown at FIG. 5, alternate designs and configurations that implement the hair clamp adapter can be implemented without departing from the scope and spirit of the disclosure. In addition, while an example of a hair clamp adapter 300 is shown at FIGS. 3A-3B, alternate designs and configurations of the hair clamp adapter 300 can be implemented without departing from the scope and spirit of the disclosure.

Referring again to FIG. 5, there is shown a hair clamp adapter 300 with a cutaway shown of an example formulation delivery device 400, depicting part of a hair treatment to apply a haircare formulation to the hair of an individual. The formulation delivery device 400 is configured to receive a formulation cartridge 402 type (including a cleaning cartridge of the same type). An embodiment of a formulation cartridge of the formulation cartridge 402 type is described herein; the formulation cartridge 402 shown in FIG. 5 shall be understood to have the same features as described there. Some embodiments of formulation delivery device 400 include the formulation cartridge 402 and/or an optional pull through adaptor 404.

Formulation delivery device 400 includes a reusable handle formed from an ABS plastic or similar rigid polymer or other material, and in embodiments is an assembly formed from a plurality of shells configured to be joined together with fastening elements such as snaps, screws, or the like. Reusable handle has a hollow, elongate gripping portion with a cartridge cavity therein which is sized and dimensioned to receive the formulation cartridge 402 type. In embodiments, the cavity includes keying features that facilitate correct insertion of the formulation cartridge 402 type. For example, embodiments include a cartridge interface 408 disposed in the opening and having a flat docking surface that interfaces with a corresponding docking surface of the formulation cartridge 402 when the latter is correctly inserted into the opening.

Formulation dispensing assembly 410 dispenses formulation or cleaning liquid from the formulation cartridge 402, and includes a pump, fluid conduits, a mixing chamber, and a reciprocating nozzle assembly 414 with nozzles that extend away from the forward end of the reusable handle in between a plurality of optional standoff portions (e.g., 416 of FIG. 1). As shown at FIG. 5, the reciprocating nozzle assembly includes a plurality of annular nozzles that reciprocate back-and-forth along a track of the reusable handle while dispensing formulation onto a user's skin or hair. In embodiments, the reciprocating nozzle assembly reciprocates at a reciprocating amplitude of about 7.0-12.0 mm (e.g., 8.0 mm-11.0 mm, or 9.0-10.0 mm) and/or at a reciprocating frequency of about 5.0 Hz-10.0 Hz (e.g., 6.0 Hz-9.0 Hz, 6.0 Hz-8.0 Hz), which are adjustable by the formulation routine module, cleaning routine module, user routine module, manual adjustment module, or other module (e.g., one or more modules or method steps of a software application).

In embodiments, the reusable handle also houses a number of sub-assemblies, including a controller 412, which includes a processor and data store storing a number of modules (e.g., circuitry configured for logic operations and/or methods), cartridge authentication interface 430, power supply, formulation dispensing assembly 410, and an optional position sensor. Formulation stored in the formulation vessel(s) 418 can be delivered and mixed within the formulation delivery device 400 for contact with the compressible substrates 306*a*, 306*b* and application to the hair of the individual. As such, formulation cartridge 402 has one or more formulation vessels 418 (e.g., pouches or packets) disposed therein, each of which has an output nozzle 420 protruding through a distal (forward) end of the formulation cartridge 402 in a configuration that fluidically connects with a corresponding formulation inlet 422 of the formulation dispensing assembly 410 when the formulation cartridge 402 is fully inserted into the cartridge cavity.

In embodiments, a button 426 disposed on the reusable handle and electrically connected to the controller 412 activates features of the formulation delivery device 400. In embodiments, depressing the button 426 activates a sleep/awake module stored in controller 412, thereby awakening formulation delivery device 400 from a sleep state to an awake state. In embodiments, pressing button 426 while a formulation cartridge is inserted into the reusable handle activates a formulation routine module stored in controller 412, thereby initiating a formulation routine.

In embodiments, pressing button 426 while a cleaning cartridge is inserted into the reusable handle activates a cleaning routine module stored in the controller 412, thereby initiating a cleaning routine. Visual indicators 428 (e.g., LEDs) disposed along the reusable handle indicate one or more of a remaining formulation quantity or a remaining battery life, e.g., based upon a dispensed time determined by the formulation routine module of the controller. Embodiments can include additional buttons and/or a different number of visual indicators 428 with different functionalities, and the illustrated embodiment is not limiting. In embodiments, visual indicator 428 is a multi-segment LED with each segment corresponding to an equal proportion of the formulation remaining in the formulation cartridge.

Controller 412 comprises logic (stored in a data store thereof), which when executed by a processor of the controller 412, causes a cartridge authentication interface 430 disposed in the reusable handle (e.g., an RFID reader) to read an encryption chip on the formulation cartridge 402 in order to authenticate the formulation cartridge 402. The encryption chip stores at least one of the formulation cartridge 402, a formulation identification, a beginning formulation quantity, a formulation expiration date, or a formulation production date.

Controller 412 also comprises logic, which when executed, causes the formulation delivery device to execute, based upon authenticating the formulation cartridge 402, a formulation routine that dispenses a mixed formulation (of the first formulation and the second formulation) from the formulation cartridge 402 through the formulation dispensing assembly. For example, the formulation delivery device authenticates the first and second formulations after (or upon) insertion of a formulation cartridge into the reusable handle, and then, in response to pressing a button on the reusable handle, executes a formulation routine which causes formulation dispensing assembly 410 to continuously or continually mix the first and second formulations, and to dispense the same from the reciprocating nozzle assembly at one or more of the following predetermined device operating parameters for as long as the button is depressed: a formulation flow rate, a reciprocating frequency, or a reciprocating amplitude.

In embodiments, controller 412 also comprises logic, which when executed, causes the formulation delivery device to execute, based upon authenticating a cleaning cartridge inserted into the reusable handles, a cleaning routine that dispenses a cleaning liquid through the formulation dispensing assembly. For example, the formulation delivery device authenticates a cleaning cartridge inserted into the reusable handle, and then, in response to pressing a button on the reusable handle, executes a cleaning routine which causes formulation dispensing assembly 410 to continuously or continually dispense a cleaning liquid (e.g., water) from the reciprocating nozzle assembly at one or more of the following predetermined device operating parameters for as long as the button is depressed: a cleaning liquid flow rate, a reciprocating frequency, or a reciprocating amplitude. In some embodiments, the cleaning liquid flow rate is higher than any formulation flow rate of one or more of the formulation routines stored in the controller 412, for the advantage of effectively flushing residual formulation from the formulation dispensing assembly.

In the claims and for purposes of the present disclosure, the terms "a", "an", "the", and the like, refer to the singular and the plural forms of the object or element referenced.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

As used herein, "system" and "computational system" refer to one or more computational devices that are configured for performing all or part of any method of the disclosure, in any order or sequence of steps, optionally in combination with one or more other computational devices that are configured for performing all or part of any method of the disclosure, in any order or sequence of steps. In at least some instances, a method can be performed by two or more computational devices that together form at least part of a computational system, and in such instances, the steps carried out by a first computational device can be complementary to the steps carried out by a second computational device. In other instances, a method can be performed by one computational device that forms at least part of a computational system.

As used herein, "computational device" refers to a physical hardware computing device that is configured for performing all or part of any method of the disclosure, in any order or sequence of steps, optionally with human input. In embodiments, circuitry of such a computational device is configurable with a processor and processor-executable instructions stored on a non-transitory machine-readable medium of the computational device, as a non-limiting example, but other approaches for configuring circuitry of the computational device can be implemented in embodiments. In embodiments, the computational device includes a processor for execution of instructions stored on a non-transitory machine-readable medium, for enabling the processor to carry out all or part of a method or process of the disclosure. Accordingly, in embodiments, a computational device includes a software application configured to perform all or part of one or more methods or processes of the disclosure, in any order or combination. However, in embodiments, a computational device includes dedicated hardware circuitry. Further configuration of circuitry of the computational device can include networking circuitry, for example, circuitry configured for a wireless connection, such as a Bluetooth® connection, a Bluetooth® low energy (BLE) connection, and/or a Wi-Fi® connection, and/or a wired connection. The networking circuitry, in combination with circuitry of the computational device, can be used to request, retrieve, and/or receive data from a remote server, for example. In embodiments, the circuitry can include operable connection of one or more sensors with the processor, or other circuitry, for performing logic operations and/or methods based on data received from the one or more sensors, for example.

While various types of computational devices useful for systems of the disclosure are discussed herein or are otherwise envisioned, an example computational device can be implemented as a device on a network. Examples can include servers, personal computers, mobile phones, smart phones, tablet computers, embedded computational devices, and other devices that can be used to implement portions of embodiments of the present disclosure. Embodiments of a computational device can be implemented in or can include an application-specific integrated circuit (ASIC), a field-programmable gate array (FPGA), or other customized device. Moreover, those of ordinary skill in the art and others will recognize that the computational device can be any one of any number of currently available or yet to be developed devices.

In its most basic configuration, a computational device includes at least one processor and a system memory connected by a communication bus. Depending on the exact configuration and type of device, the system memory can be volatile or nonvolatile memory, such as read only memory ("ROM"), random access memory ("RAM"), EEPROM, flash memory, or similar memory technology. Those of ordinary skill in the art and others will recognize that system memory typically stores data and/or program modules that are immediately accessible to and/or currently being operated on by the processor. In this regard, the processor can serve as a computational center of the computational device by supporting the execution of instructions.

A computational device can include a network interface comprising one or more components for communicating with other devices over a network. Embodiments of the present disclosure can access basic services that utilize the network interface to perform communications using common network protocols. The network interface can also include a wireless network interface configured to communicate via one or more wireless communication protocols, such as Wi-Fi, 2G, 3G, LTE, WiMAX, Bluetooth, Bluetooth low energy, and/or the like. As will be appreciated by one of ordinary skill in the art, the network interface can represent one or more wireless interfaces or physical communication interfaces described and illustrated above with respect to particular components of the computational device.

The computational device also includes a storage medium. However, services can be accessed using a computational device that does not include means for persisting data to a local storage medium. Therefore, the storage medium can be optional. In any event, the storage medium can be volatile or nonvolatile, removable or nonremovable, implemented using any technology capable of storing information such as, but not limited to, a hard drive, solid state drive, CD ROM, DVD, or other disk storage, magnetic cassettes, magnetic tape, magnetic disk storage, and/or the like.

Suitable implementations of computational devices that include a processor, system memory, communication bus, storage medium, and network interface are known and commercially available. For ease of illustration and because it is not important for an understanding of the claimed subject matter, the disclosure does not show some of the typical components of many computational devices. In this regard, the computational device can include input devices, such as a keyboard, keypad, mouse, microphone, touch input device, touch screen, tablet, and/or the like. Such input devices can be coupled to the computational device by wired or wireless connections including RF, infrared, serial, parallel, Bluetooth, Bluetooth low energy, USB, or other suitable connections protocols using wireless or physical connections. Similarly, the computational device can also include output devices such as a display, speakers, printer, and the like. Since these devices are well known in the art, they are not illustrated or described further herein.

The principles, example embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

Non-Limiting Embodiments

While general features of the disclosure are described and shown and particular features of the disclosure are set forth in the claims, the following non-limiting embodiments relate to features, and combinations of features, that are explicitly envisioned as being part of the disclosure. The following non-limiting Embodiments contain elements that are modular and can be combined with each other in any number, order, or combination to form a new non-limiting Embodiment, which can itself be further combined with other non-limiting Embodiments.

Embodiment 1. A hair clamp adapter configured for attachment to and use with a formulation delivery device to controllably apply a cosmetic composition to hair of an individual, the hair clamp adapter comprising: a moving handle slidingly attached to a moving arm that comprises a first compressible substrate thereon, and a stationary handle comprising a stationary arm that comprises a second compressible substrate thereon, wherein the moving arm is hingedly attached to the stationary arm via a hinge and is slidingly attached to the stationary handle; wherein the stationary arm and the second compressible substrate each comprises a plurality of apertures that are configured to align to form a plurality of formulation pathways for passage of the cosmetic composition therethrough; and wherein a bias of the hair clamp adapter biases the hair clamp adapter toward an unclamped configuration, and wherein the bias is overcome the hair clamp adapter transitions toward a clamped configuration.

Embodiment 2. The hair clamp adapter of Embodiment 1 or any other Embodiment, wherein the moving handle is slidingly attached to the moving arm via a sliding male member slidingly engaged within an elongated aperture.

Embodiment 3. The hair clamp adapter of any one of Embodiments 1-2 or any other Embodiment, wherein the moving arm is slidingly attached to the stationary handle via a sliding male member slidingly engaged within an elongated aperture.

Embodiment 4. The hair clamp adapter of any one of Embodiments 1-3 or any other Embodiment, wherein the bias is produced by a spring attached to the moving handle at a first end thereof and attached to the stationary handle at a second end thereof, wherein the spring is biased toward an expanded configuration to distance the moving handle from the stationary handle and distance the moving arm from the stationary arm to form the open configuration.

Embodiment 5. The hair clamp adapter of any one of Embodiments 1-4 or any other Embodiment, further comprising a living hinge that hingedly connects a proximal portion of the moving handle to a proximal portion of the stationary handle and is configured to prevent contact between a portion of a hand of the individual and a junction that includes the moving arm and the stationary arm for avoidance of injury.

Embodiment 6. The hair clamp adapter of any one of Embodiments 1-5 or any other Embodiment, wherein the stationary handle and arm comprises a proximal connector and a distal connector that are configured to connect the hair clamp adaptor to the formulation delivery device.

Embodiment 7. The hair clamp adapter of any one of Embodiments 1-6 or any other Embodiment, wherein the proximal connector, the distal connector, or both, comprises a magnet configured for a magnetic attachment of the hair clamp adapter to the formulation delivery device via contact with one or more corresponding magnets of the formulation delivery device.

Embodiment 8. The hair clamp adapter of any one of Embodiments 1-7 or any other Embodiment, wherein the stationary arm comprises a plurality of standoff portion slots configured as apertures for receipt and securement of a plurality of standoff portions of the formulation delivery device therein, for maintenance of an orientation of the hair clamp adapter relative to an orientation of the formulation delivery device during attachment and use.

Embodiment 9. The hair clamp adapter of any one of Embodiments 1-8 or any other Embodiment, wherein apertures of the plurality of apertures of the second compressible substrate are positioned between opposing standoff portion slots of the plurality of standoff portion slots.

Embodiment 10. The hair clamp adapter of any one of Embodiments 1-9 or any other Embodiment, wherein the plurality of formulation pathways are positioned for a fluid connection with the reciprocating nozzle assembly for passage of the cosmetic composition from the reciprocating nozzle assembly through the plurality of formulation pathways via the fluid connection.

Embodiment 11. The hair clamp adapter of any one of Embodiments 1-10 or any other Embodiment, wherein passage of the cosmetic composition through the plurality of formulation pathways contacts the cosmetic composition to the second compressible substrate for absorption of the cosmetic composition therein for delivery to the hair of the individual through the second compressible substrate.

Embodiment 12. The hair clamp adapter of any one of Embodiments 1-11 or any other Embodiment, wherein passage of the cosmetic composition through the plurality of formulation pathways passes the cosmetic composition through the plurality of apertures of the second compressible substrate such that the cosmetic composition forms a plurality of formulation dribbles on the second compressible substrate.

Embodiment 13. The hair clamp adapter of any one of Embodiments 1-12 or any other Embodiment, wherein the first and second compressible substrates are removable from the moving arm and the stationary arm, respectively.

Embodiment 14. The hair clamp adapter of any one of Embodiments 1-13 or any other Embodiment, wherein passage of the cosmetic composition through the plurality of formulation pathways forms a plurality of formulation dribbles on the second compressible substrate, and the bias is overcome to transition the hair clamp adapter toward the clamped configuration such that the first compressible substrate is contacted with the plurality of formulation dribbles for transfer of the cosmetic composition to the first compressible substrate to evenly apply the cosmetic composition to the hair of the individual.

Embodiment 15. A formulation delivery device or formulation delivery system comprising the hair clamp adapter of any one of Embodiments 1-14 or any other Embodiment.

While illustrative embodiments have been illustrated and described, it will be appreciated that various changes can be made therein without departing from the spirit and scope of the disclosure.

The embodiments of the invention in which an exclusive property or privilege is claimed are defined as follows:

1. A hair clamp adapter configured for attachment to and use with a formulation delivery device to controllably apply a cosmetic composition to hair of an individual, the hair clamp adapter comprising:

a moving handle slidingly attached to a moving arm that comprises a first compressible substrate thereon, and a stationary handle comprising a stationary arm that comprises a second compressible substrate thereon, wherein the moving arm is hingedly attached to the stationary arm via a hinge and is slidingly attached to the stationary handle;

wherein the stationary arm and the second compressible substrate each comprises a plurality of apertures that are configured to align to form a plurality of formulation pathways for passage of the cosmetic composition therethrough; and wherein a bias of the hair clamp adapter biases the hair clamp adapter toward an unclamped configuration, and wherein when the bias is overcome the hair clamp adapter transitions toward a clamped configuration.

2. The hair clamp adapter of claim 1, wherein the moving handle is slidingly attached to the moving arm via a sliding male member slidingly engaged within an elongated aperture.

3. The hair clamp adapter of claim 1, wherein the moving arm is slidingly attached to the stationary handle via a sliding male member slidingly engaged within an elongated aperture.

4. The hair clamp adapter of claim 1, wherein the bias is produced by a spring attached to the moving handle at a first end thereof and attached to the stationary handle at a second end thereof, wherein the spring is biased toward an expanded configuration to distance the moving handle from the stationary handle and distance the moving arm from the stationary arm to form an open configuration.

5. The hair clamp adapter of claim 1, further comprising a living hinge that hingedly connects a proximal portion of the moving handle to a proximal portion of the stationary handle and is configured to prevent contact between a portion of a hand of the individual and a junction that includes the moving arm and the stationary arm for avoidance of injury.

6. The hair clamp adapter of claim 1, wherein the stationary handle and the stationary arm comprises a proximal connector and a distal connector that are configured to connect the hair clamp adaptor to the formulation delivery device.

7. The hair clamp adapter of claim 6, wherein the proximal connector, the distal connector, or both, comprises a magnet configured for a magnetic attachment of the hair clamp adapter to the formulation delivery device via contact with one or more corresponding magnets of the formulation delivery device.

8. The hair clamp adapter of claim 1, wherein the stationary arm comprises a plurality of standoff portion slots configured as apertures for receipt and securement of a plurality of standoff portions of the formulation delivery device therein, for maintenance of an orientation of the hair clamp adapter relative to an orientation of the formulation delivery device during attachment and use.

9. The hair clamp adapter of claim 8, wherein apertures of the plurality of apertures of the second compressible substrate are positioned between opposing standoff portion slots of the plurality of standoff portion slots.

10. The hair clamp adapter of claim 1, wherein the plurality of formulation pathways are positioned for a fluid connection with a reciprocating nozzle assembly for passage of the cosmetic composition from the reciprocating nozzle assembly through the plurality of formulation pathways via the fluid connection.

11. The hair clamp adapter of claim 10, wherein passage of the cosmetic composition through the plurality of formulation pathways contacts the cosmetic composition to the second compressible substrate for absorption of the cosmetic composition therein for delivery to the hair of the individual through the second compressible substrate.

12. The hair clamp adapter of claim 10, wherein passage of the cosmetic composition through the plurality of formulation pathways passes the cosmetic composition through the plurality of apertures of the second compressible substrate such that the cosmetic composition forms a plurality of formulation dribbles on the second compressible substrate.

13. The hair clamp adapter of claim 1, wherein the first and second compressible substrates are removable from the moving arm and the stationary arm, respectively.

14. The hair clamp adapter of claim 1, wherein passage of the cosmetic composition through the plurality of formulation pathways forms a plurality of formulation dribbles on the second compressible substrate, and the bias is overcome to transition the hair clamp adapter toward the clamped configuration such that the first compressible substrate is contacted with the plurality of formulation dribbles for transfer of the cosmetic composition to the first compressible substrate to evenly apply the cosmetic composition to the hair of the individual.

15. A formulation delivery device or formulation delivery system comprising the hair clamp adapter of claim 1.

* * * * *